US007140936B2

(12) United States Patent
Roberts

(10) Patent No.: US 7,140,936 B2
(45) Date of Patent: Nov. 28, 2006

(54) ISLAND SWIM RAFT

(76) Inventor: John Roberts, 2800 Pleasant Valley, Brighton, MI (US) 48114

( * ) Notice: Subject to any disclaimer, the term of this patent is extended or adjusted under 35 U.S.C. 154(b) by 0 days.

(21) Appl. No.: 10/777,393

(22) Filed: Feb. 12, 2004

(65) Prior Publication Data

US 2005/0181688 A1 Aug. 18, 2005

(51) Int. Cl.
*B63B 35/38* (2006.01)
*B63C 9/28* (2006.01)

(52) U.S. Cl. ..... 441/36; 441/130

(58) Field of Classification Search ..... 441/13, 441/35, 38, 40, 129, 130, 36; 472/129, 345, 472/346, 351; 114/345, 346, 351; D12/301, D12/316; D21/802, 803, 808, 809
See application file for complete search history.

(56) References Cited

U.S. PATENT DOCUMENTS 3,182,340 A * 5/1965 Gentile ..... 441/32
3,327,686 A * 6/1967 Holden ..... 119/251
3,517,649 A * 6/1970 Holden ..... 119/253
3,619,833 A * 11/1971 Keller ..... 441/35
3,694,837 A * 10/1972 Von Norring ..... 114/264
3,707,736 A * 1/1973 Bass ..... 441/13
3,814,439 A * 6/1974 Simon ..... 473/196
3,883,913 A 5/1975 Givens
3,893,201 A * 7/1975 Mallory ..... 441/1
4,819,874 A * 4/1989 Geiger ..... 239/23
4,825,798 A * 5/1989 Abeille ..... 114/267
4,828,520 A 5/1989 Baughman et al.
4,890,569 A 1/1990 Givens
4,990,542 A 2/1991 Motani et al.
5,013,273 A 5/1991 Williams
5,135,440 A * 8/1992 Smollar et al. ..... 472/128
5,219,307 A 6/1993 Morrison
5,390,620 A 2/1995 Murphy
5,775,248 A * 7/1998 Simola ..... 114/267
5,799,440 A 9/1998 Ishikawa et al.
5,885,123 A 3/1999 Clifford
5,916,672 A 6/1999 Reeves et al.
6,003,464 A 12/1999 Long
6,234,857 B1 * 5/2001 Suellentrop ..... 441/129
6,280,271 B1 * 8/2001 Peterson ..... 441/40
6,576,332 B1 6/2003 Yoshizaki et al.
6,773,355 B1 * 8/2004 Lekhtman ..... 472/128
2002/0095947 A1 * 7/2002 Treppedi et al. ..... 62/457.9
2003/0046755 A1 3/2003 Hingle
2003/0115822 A1 6/2003 LeJeune et al.
2003/0208954 A1 * 11/2003 Bulk ..... 47/39
2004/0028478 A1 * 2/2004 Lekhtman ..... 405/219
2004/0187418 A1 * 9/2004 Day et al. ..... 52/315

* cited by examiner

*Primary Examiner*—Jesús D. Sotelo
(74) *Attorney, Agent, or Firm*—Gifford, Krass, Groh, Sprinkle, Anderson & Citkowski, P.C.

(57) ABSTRACT

A swim raft constructed of a three-dimensional shaped body exhibiting a substantially planar bottom, a curved side, and a sloping top. The body has an outer shell constructed of a polyester laminate shell material and which encapsulates an inner foam core. At least one decorative indicia is associated with the sloping top and includes an artificial grass applied over and across a predetermined area associated with the top. The decorative indicia further includes at least one structural object projecting from the sloping top selected from such as a flag pole, a miniaturized lighthouse and an artificial palm tree.

8 Claims, 2 Drawing Sheets

ISLAND SWIM RAFT

BACKGROUND OF THE INVENTION

1. Field of the Invention

The present invention relates generally to flotation articles and, more particularly, to an island shaped swim raft exhibiting significant buoyancy and stability characteristics.

2. Description of the Prior Art

The prior art is well documented with examples of buoyant articles and apparatuses for use in varying applications. A first example of this is set forth in U.S. Pat. No. 5,916,672, issued to Reeves, and which teaches a thermoplastic multi-layer composite structure including a co-extruded acrylic polypropylene outer skin and high melt strength polypropylene substrate which is attached to a first surface of a polypropylene foam core. An inner polypropylene skin can be provided and is attached to a second surface of the foam core. The foam core can be either constructed from an expanded polypropylene or an extruded polypropylene. The extruded foam core can vary in density to provide a composite foam core, and in particular one in which the lowest density foam is provided at the center of the core and the varying densities of the foam core extend outward from the center in numerical order.

U.S. Pat. No. 5,219,307, issued to Morrison, teaches a convertible recreational raft that can be used on a pool or lake and which includes a floating raft defining a relatively large central opening to surround the users. A mesh material may be stretched over then releasably fastened to the top of the raft to form a closed interior whereby the only entry is from the water by way of the opening in the raft. A rigid panel, the top of which provides a raised deck for sunbathing or diving, may also be releasably fastened to the top of the raft, which configuration also results in a closed interior below the panel and within the raft inner perimeter that provides privacy and protection from cool breezes for users.

U.S. Patent Application Publication 2003/0046755, to Hingle, teaches a floating bug, sun and privacy dome of convex shape constructed of a plurality of tubular bent members connected at a common point at the top and to a tension ring at the base, forming an interior cavity of adequate size to cover an adult floating on a raft or standing in a pool. The exterior is covered in a fabric or mesh weave of sufficiently small opening to prevent the entry of mosquitoes and insects, also providing shade from the sun. The exterior covering also offers privacy from observers located at a distance. The fabric is held taut by such as VELCRO portions, these typically including opposing and interengageable pairs of fasteners, zippers or snaps for easy assembly and disassembly. Removable floats consisting of cylindrical lightweight rigid foam or inflatable PVC material are installed to support the structure in water.

U.S. Pat. No. 4,828,520, issued to Baughman, teaches a modular life raft in which a canopy, canopy support, floor pads and boarding ramp and ballast are detachably attached to a life raft hull and floor assembly. Modular construction facilitates maintenance and repair and may reduce the cost and volume of material employed in spares programs necessary to support life rafts used in commerce.

Finally, U.S. Pat. No. 5,390,620, issued to Murphy, teaches a dock float having a sealed elongated, buoyant, and hollow housing with at least one longitudinal channel for securing a joist to which decking is supported. A floatable marine dock is constructed by interconnected two similar floats by securing header boards in laterally extending recesses in the ends of each float. The width of the floatable dock is determined by the length of the header boards and decking. The length of the floatable docks may be varied by juxtapositioning in an end-to-end manner any required number of floats.

SUMMARY OF THE PRESENT INVENTION

The present invention discloses a three-dimensional and structural swim raft exhibiting a high degree of buoyancy and stability, and which in particular provides a recreational platform for such as larger sized bodies of water, including large swimming pools, inland lakes and the like. The swim raft includes a three-dimensional shaped body having a substantially planar bottom, a curved side and a sloping top.

The body includes a buoyant outer shell, such as which is constructed of a polyester laminate shell, a fiberglass material, or any other suitable plastic or polymer material exhibiting a water impervious outer layer and which surrounds an inner foam core. It is also envisioned that an elastomer/rubber coating may be utilized as a buoyant outer shell. In cross section, the body exhibits a substantially elliptical configuration with a sloping upper surface, a substantially planar bottom surface, and a curved, circumferentially extending and interconnecting side.

A gel coat is usually applied over the laminate shell and the areas associated with the top surface typically include the application of a textured non-skid surface. Decorative indicia associated with the sloping upper surface typically includes an artificial grass composition (typically such as including a 63% mix of polypropylene poly-loom fibers combined with 37% polypropylene monofilament fibers).

Additional features include the provision of an extending structure of some sort, usually from the sloping upper surface associated with the swim raft, and which may typically include such as a flag pole, miniaturized light house and artificial palm trees. The structures typically contribute to an overall theme associated with the swim raft design, such as including golf, nautical or tropical motifs.

BRIEF DESCRIPTION OF THE DRAWINGS

Reference will be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
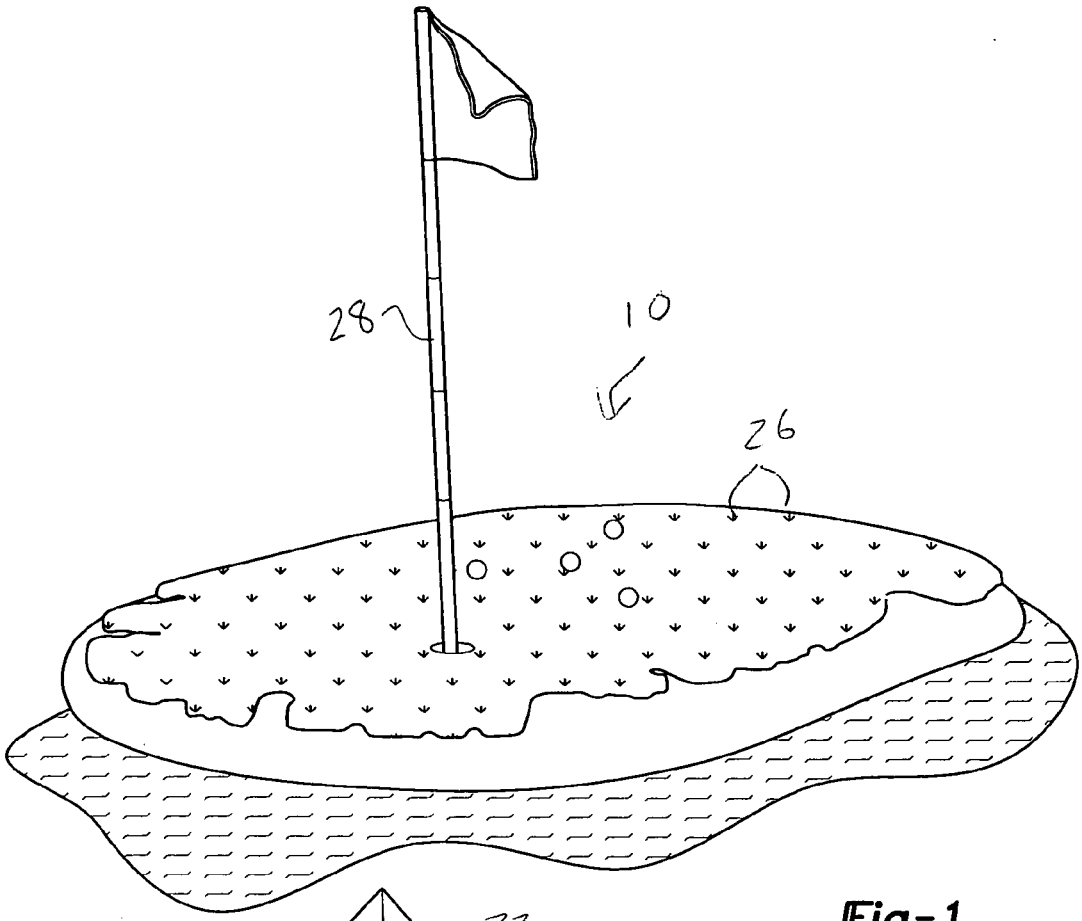
FIG. 1 is a perspective view of an island swim raft according to a first preferred embodiment of the present invention.
Figure 2:
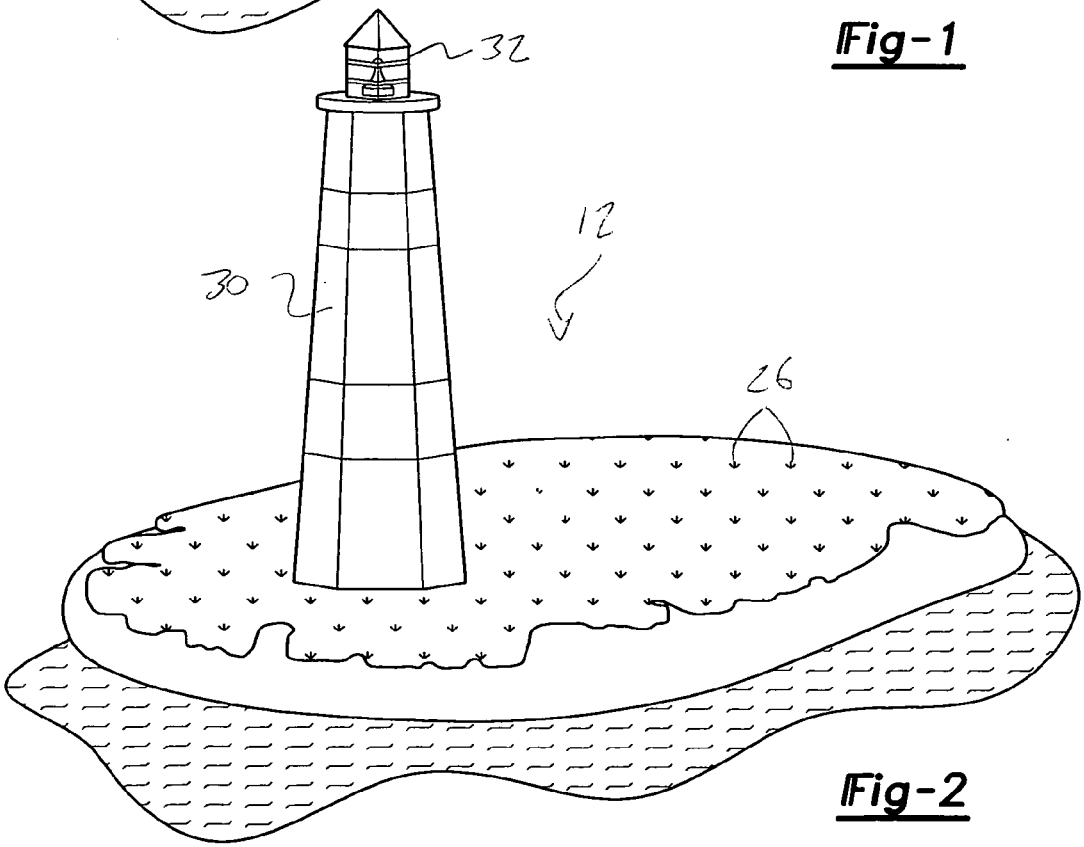
FIG. 2 is a perspective view of an island swim raft according to a second preferred embodiment of the present invention.
Figure 3:
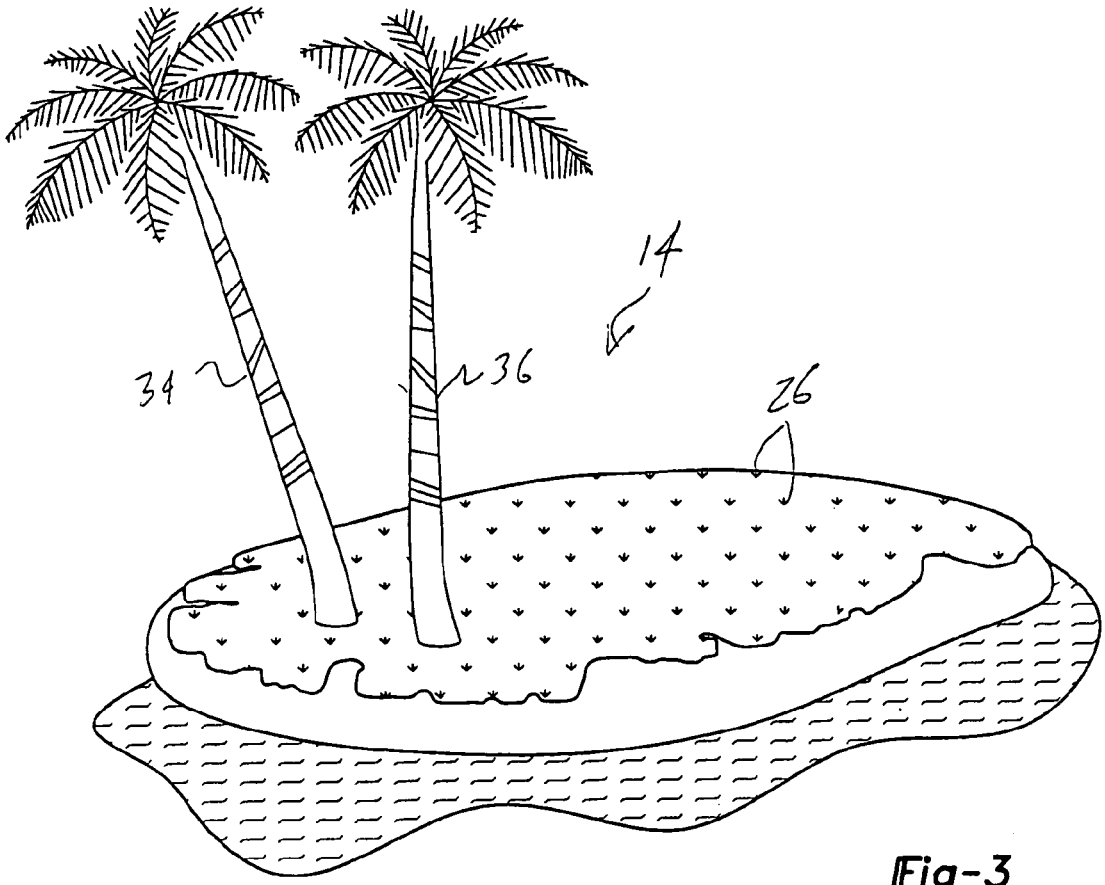
FIG. 3 is a perspective view of an island swim raft according to a third preferred embodiment of the present invention.

Referring now to each of FIGS. 1, 2 and 3 and in succession, examples of swim raft constructions are illustrated at 10, 12 and 14 according to first, second and third preferred embodiments of the present invention. Further referenced in cutaway at 16 in FIG. 4 is an illustration of a further succeeding swim raft construction and, when read in combination with the various perspective illustrations of FIGS. 1–3, will provide the basis of the following description.

Each of the swim raft constructions 10, 12 and 14 exhibits a three-dimensional structure exhibiting a substantial degree of buoyancy and stability. In particular, and referencing again the cutaway of FIG. 4, selected body 16 includes a substantially planar bottom 18, a curved, circumferentially extending and interconnecting side 20, and a sloping top 22, in combination providing the design with an overall cross sectional elliptical configuration. It is also understood that the perspective illustrations of FIGS. 1–3 and the cutaway illustration of FIG. 4 identify general preferred configurations associated with the present design, it being further understood that slight modifications are capable of being made to the circumferential outline, slope of the top, side curvature, etc., associated with any specific island shape.

Figure 4:
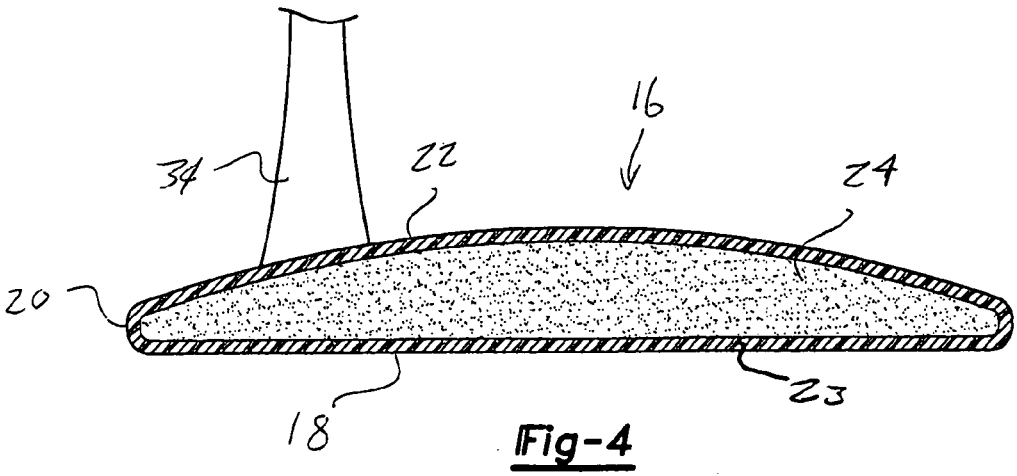
FIG. 4 is a cutaway view of a selected island swim raft and illustrating the fiberglass outer construction with inner foam core.

In each instance, and referring again to illustration 16 in FIG. 4, the body includes an outer shell 23 constructed of a polyester laminate shell material and which encapsulates an inner foam core 24. Surface layers of the polyester laminate outer shell (referenced in combination by bottom 18, side 20 and top 22) preferably further includes such a polyester based and mixable pigment (to provide color to the structure), an outer gel coat and an exteriorly textured and non-skid surface (such as which is typically associated with the sloping top 22).

It is also envisioned that the outer shell 22 may be constructed from a range of suitable and buoyant materials, among them including without limitation such as fiberglass, plastic, polymer an elastomer based materials. In each instance, the outer shell exhibits a sufficient degree of buoyancy and moisture imperviousness.

Referring to each of FIGS. 1, 2, and 3, a decorative indicia associated with each of the swim rafts includes the provision of an artificial grass, consistently identified at 26 in each of FIGS. 1–3. The artificial grass composition typically includes such as a 63% mix of polypropylene poly-loom fibers combined with 37% polypropylene monofilament fibers and in order to provide the desired texture and water resistance. It is also envisioned that the length and consistence of the artificial grass 26 be such that it not significantly interfere with the skid-resistant properties of the gel surface coat.

Referring to FIG. 1, the first design variant 10 of the swim raft further includes the provision of a flagpole 28 extending from the sloping top surface (note also regulation cup from which the flag projects) and in order to provide an overall golf theme to the swim raft. Further referencing the example 12 in FIG. 2, a miniaturized lighthouse design 30 is shown and which includes a plywood construction and further may have such as a solar powered light (night sensor) 32 mounted atop the structure.

Referring still further to the example illustrated at 14 in FIG. 3, a pair of artificial palm trees 34 and 36, exhibiting wood faux trunks and palm leaves, are shown and which project from given locations associated with the sloping top surface of the swim raft. As further shown in FIG. 4, selected tree 34 is again referenced in the cutaway illustration, by which a given recreational design is accomplished.

Although they can vary, design specifications according to a preferred variant include the swim raft exhibiting an overall 8'×10' area, with a determined thickness, and typically an overall weight in the area of 250 lbs. The buoyancy characteristics of the design are such that they can support four adults, or 600 lbs, and which meets U.S. Coast Guard buoyancy requirements.

A method of constructing a swim raft is also disclosed, incorporating the substantially above-described structure, and including the steps of forming a three-dimensional shaped buoyant and stable body from a foamable core material and such that said body exhibits a substantially planar bottom, a circumferentially extending and curved side, and a sloping top. Additional steps include coating the body with a polyester laminate shell material and which encapsulates the inner foam core and applying at least one decorative indicia upon the top surface.

Additional steps include applying a pigmented polyester gel coat applied over the polyester laminate shell, and applying a textured non-skid surface applied upon the gel coat. Yet additional steps associated with the decorative indicia include applying an artificial grass composition over the sloping top and across a predetermined surface area, as well as applying at least one structural object in projecting fashion from the sloping top.

Having described my invention, other and additional preferred embodiments will become apparent to those skilled in the art to which it pertains, and without deviating from the scope of the appended claims.

I claim:

1. A swim raft, comprising:

a three-dimensional shaped body exhibiting, in cross section, a substantially elliptical configuration with a substantially planar bottom, a curved side, and a substantially smoothed face and sloping top;

said body having an outer shell constructed of a first buoyant material comprising a polyester laminate, a pigmented polyester gel coat being applied over said polyester laminate shell and which encapsulates a solid inner foam core material constructed of a second buoyant material, a textured nonskid surface applied upon said gel coat; and at least one decorative indicia associated with and projecting upwardly from said sloping top in order to create a recreational platform of sufficient size and dimension to support one or more individuals.

2. The swim raft as described in claim 1, said body exhibiting a specified shape and size and further comprising at least a polyester, plastic, polymer, or elastomer based material.

3. The swim raft as described in claim 1, said decorative indicia further comprising an artificial grass applied over said sloping top and across a predetermined surface area.

4. The swim raft as described in claim 1, said decorative indicia further comprising a flag pole extending from said sloping top.

5. The swim raft as described in claim 1, said decorative indicia further comprising a miniaturized lighthouse structure extending from said sloping top.

6. The swim raft as described in claim 1, said decorative indicia further comprising at least one artificial palm tree extending from said sloping top.

7. A swim raft, comprising:

a three-dimensional shaped body exhibiting, in cross section, a substantially elliptical configuration with a substantially planar bottom, a curved side, and a sloping top;

said body having an outer shell constructed of a buoyant shell material and which encapsulates a solid inner foam core;

said outer shell further comprising a laminate, a pigmented polyester gel coat applied over said laminate outer shell, a textured nonskid surface applied upon said gel coat;

at least one decorative indicia associated with said sloping top, said decorative indicia including an artificial grass applied over said sloping top and across a predetermined area; and said decorative indicia further comprising at least one structural object projecting from said sloping top and including at least one of a flag pole, a miniaturized lighthouse and an artificial palm tree in order to create a recreational platform of sufficient size and dimension to support one or more individuals.

8. A method of constructing a swim raft, comprising the steps of:

forming a three-dimensional shaped buoyant and stable body from a solid and foamable core material such that said body exhibits a substantially elliptical configuration in cross section with a planar bottom, a circumferentially extending and curved side, and a sloping top;

coating said body with a laminate outer shell material including a polyester laminate and further comprising the step of applying a pigmented polyester gel coat over said laminate shell and which encapsulates said inner foam core;

applying a textured nonskid surface upon said gel coat;

applying at least one decorative indicia upon said top surface, said decorative indicia further comprising applying an artificial grass composition over said sloping top and across a predetermined surface area; and applying at least one structural object in protecting fashion from said sloping top.

* * * * *